US005673865A

United States Patent [19]

Stroulger

[11] Patent Number: 5,673,865

[45] Date of Patent: Oct. 7, 1997

[54] WASTE DEBARKER

[76] Inventor: Neal P. Stroulger, Compartment 38, Site 16, RR#2, Kamloops, British Columbia, Canada, V2C 2S3

[21] Appl. No.: 705,407

[22] Filed: Aug. 29, 1996

[51] Int. Cl.[6] ..... B27L 1/00; B02C 13/20

[52] U.S. Cl. ..... 241/236; 144/208.9; 144/341; 144/230; 241/24.2; 241/235

[58] Field of Search ..... 144/208.1, 208.9, 144/341, 230, 241; 241/14, 24.2, 79, 235, 236, 241

[56] References Cited

U.S. PATENT DOCUMENTS 4,685,498 8/1987 Nakajima et al. .
5,094,392 3/1992 Szombathy ..... 241/235
5,394,912 3/1995 Hume .

*Primary Examiner*—W. Donald Bray
*Attorney, Agent, or Firm*—Elbie R. de Kock

[57] ABSTRACT

A waste debarker 10 comprises a housing 12 in which is mounted a rotatable first cutting drum 14 and a rotatable second cutting drum 16 arranged in a longitudinally spaced relationship with respect to the first drum 14. The first drum 14 has a plurality of circumferentially extending flanges 24 spaced along the length thereof for supporting cutting teeth 26 thereon. The second drum 16 has a plurality of discrete lugs 34 arranged on its surface for supporting cutting teeth 26 thereon. The lugs 34 are offset with respect to the flanges 24 on the first drum 14 and extend in between the flanges 24 as the drums 14,16 are rotated. The second drum 16 is located at a higher elevation than the first drum 14. A method of debarking waste material is also provided.

15 Claims, 7 Drawing Sheets

WASTE DEBARKER

FIELD OF THE INVENTION

This invention relates to a debarker. In particular, it relates to a debarker for waste material, such as log yard waste to produce suitable material for manufacturing chips.

BACKGROUND OF THE INVENTION

For environmental and economical reasons, it has become increasingly desirable to convert log yard waste into a useable product, such as wood chips, rather than simply burning the wood waste, as has been done in the past.

It is accordingly an object of the present invention to provide a method and apparatus by which log yard waste can be converted into wood chips in an efficient and economical manner.

SUMMARY OF THE INVENTION

According to the invention there is provided a waste debarker, comprising a housing in which is mounted a rotatable first cutting drum, which has spaced along the length thereof, a plurality of circumferentially extending flanges for supporting cutting teeth thereon; and a rotatable second cutting drum arranged in a longitudinally spaced relationship with respect to the first drum, the second drum having a plurality of discrete lugs arranged on its surface for supporting cutting teeth thereon, the lugs being offset with respect to the flanges on the first drum and extending in between the flanges as the drums are rotated; and wherein the second drum is located at a higher elevation than the first drum.

Also according to the invention, there is provided a method of debarking waste material, comprising the steps of: introducing the waste material between a pair of longitudinally spaced cutting drums which are being rotated in the same direction; the drums comprising a first drum, which has spaced along the length thereof, a plurality of circumferentially extending flanges with cutting teeth thereon; and a second drum having a plurality of discrete cutting teeth supporting lugs arranged on its surface offset with respect to the flanges on the first drum and extending in between the flanges as the drums are rotated, the second drum being located at a higher elevation than the first drum; and the first drum when viewed from above being rotated in a direction towards the second drum and the second drum being rotated in a direction away from the first drum when viewed from above.

Other objects and advantages of the invention will become apparent from the description of a preferred embodiment of the invention below.

BRIEF DESCRIPTION OF THE DRAWINGS

The invention will now be described, by way of examples, with reference to the accompanying drawings, in which.

DETAILED DESCRIPTION OF PREFERRED EMBODIMENT

Figure 1:
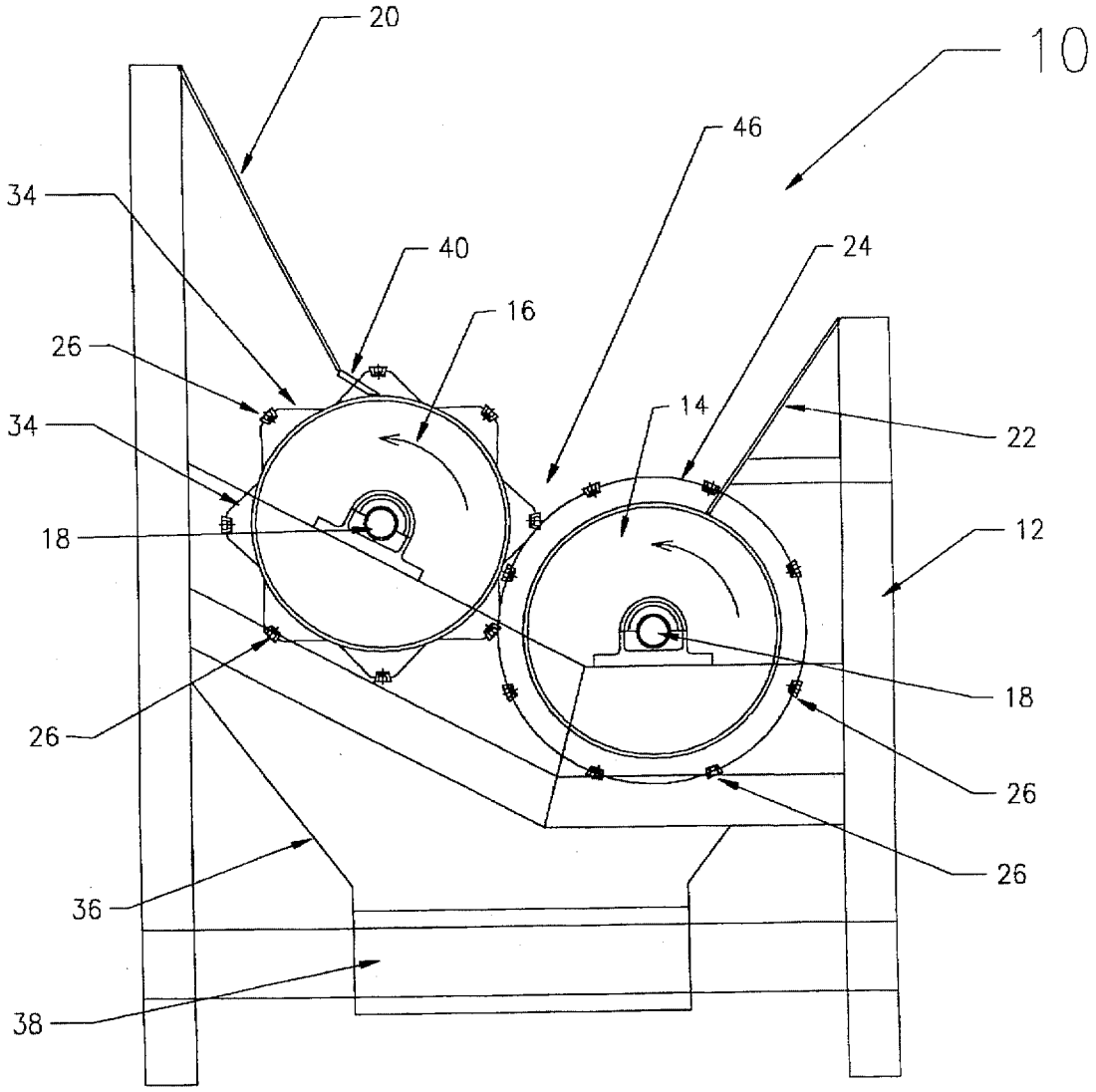
FIG. 1 is an end view of a waste debarker according to the invention.

In FIGS. 1 to 3 and 6 reference numeral 10 generally indicates a waste debarker comprising a framework or body member 12 in which a pair of cutting rollers or drums 14 and 16 are located in longitudinally spaced relationship. Some of the surrounding detail of the waste debarker 10 has been omitted in FIGS. 1 and 6.

The drums 14, 16 are mounted on shafts 18 for rotation about their longitudinal axes. The drums 14,16 are driven by any suitable means, such as electric or hydraulic motors 15 through chains (not shown) and sprockets 19.

The body member 12 has a hollow interior in which the drums 14, 16 are located. A pair of inclined plates 20 and 22 extend along the length of the body member 12 above the drums 14, 16. The plates 20 and 22 form a hopper above the drums 14, 16 for receiving the waste material to be treated by the debarker 10.

Figures 2, 3:
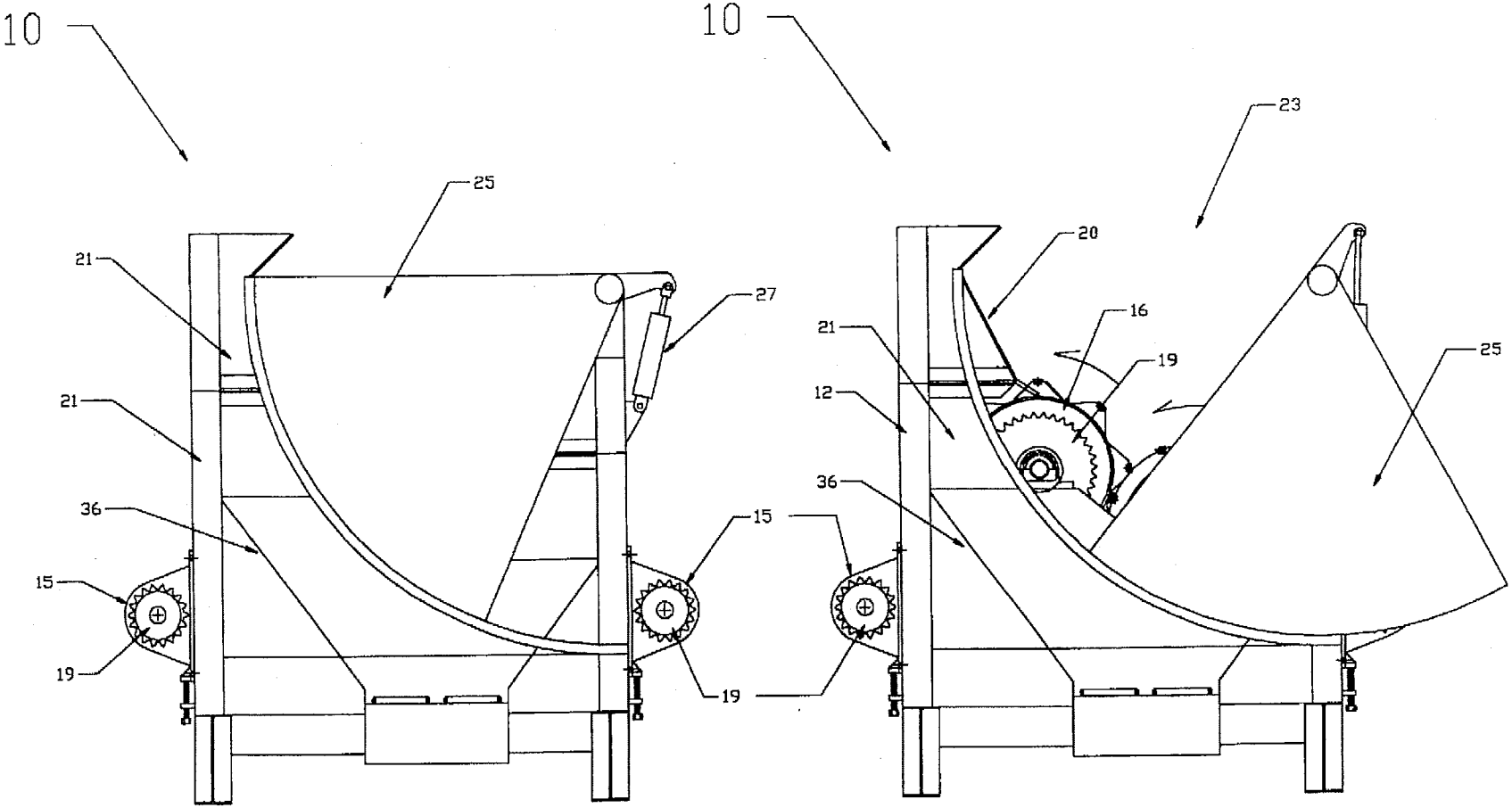
FIGS. 2 and 3 are further end views of a waste debarker of the invention, showing an end gate in closed and open positions, respectively.

An end wall 21 is provided at a discharge end of the debarker 10, as shown in FIGS. 2 and 3. The end wall 21 is provided with a discharge opening 23 and a gate 25 which is operated by a hydraulic cylinder 27 for opening and closing the discharge opening 23. The end wall 21 and gate 25 have been omitted in FIG. 1 for the sake of showing the interior detail of the debarker 10.

The drum 16 is located at a higher elevation than the drum 14 and in use is rotated at a faster speed than the lower drum 14, e.g. 35 r.p.m. as opposed to 25 r.p.m.

Figure 4:
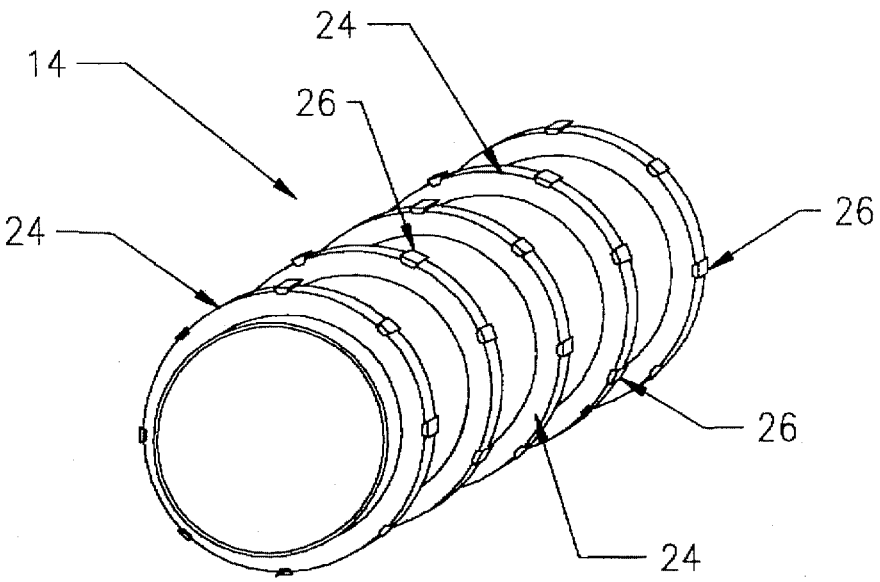
FIGS. 4 and 5 are three-dimensional views, respectively, showing first and second cutting drums of the waste debarker of FIG. 1.
Figure 7:
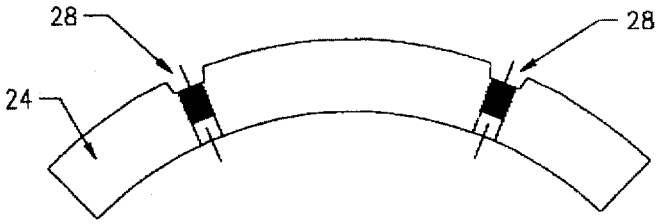
FIGS. 7 and 8, respectively, show details of cutting teeth attachment means for the drums of FIGS. 4 and 5.

The drum 14 is provided with a plurality of rings or flanges 24 spaced along its length, as shown in FIG. 4. Each ring 24 is provided with a plurality of replaceable cutting teeth 26 spaced around its circumference. As shown in FIG. 7, which shows only a segment, ring 24 is provided with recesses 28 spaced at 45° intervals around the ring 24. The recesses 28 on adjacent rings are offset an angle of 22.5°. Each recess 28 is provided with a screw-threaded hole 28 for removeably securing a cutting tooth 26 therein by means of a screw extending through a hole 32 in the tooth 26.

Figure 5:
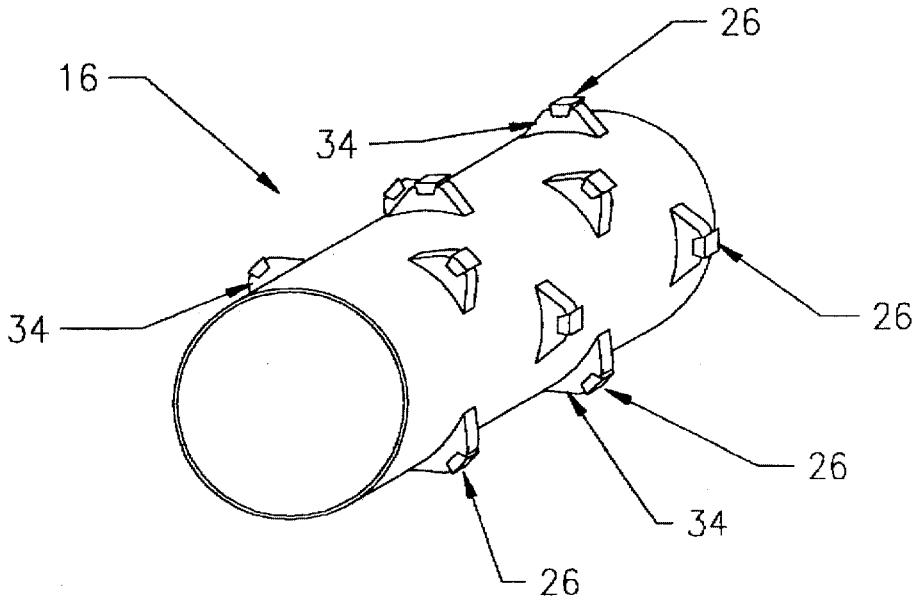
Figure 8:
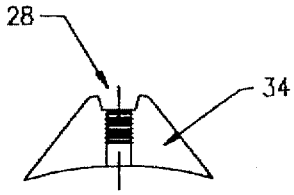

The drum 16 is provided with discrete triangular-shaped tooth holders or lugs 34 supporting the teeth 26. As shown in FIGS. 1 and 5, the holders 34 are provided in diametrically opposed pairs on the drum 16. The pairs are spaced along the length of the drum 16, with the holders 34 in adjacent pairs being offset at 45° with respect to each other. As shown in FIG. 8, each lug 34 is also provided with a recess 28 with a screw-threaded hole for securing a cutting tooth 26 therein.

Figure 9:
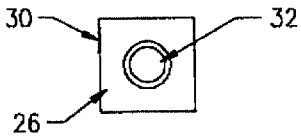
FIGS. 9 and 10, respectively, show plan and side views of a replaceable cutting tooth for use on the drums of FIGS. 4 and 5.
Figure 10:
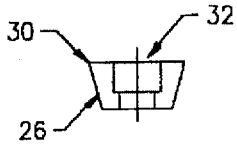

As shown in FIGS. 9 and 10, each tooth 26 is a square tapered member with a cutting edge 30 at the upper end of the taper. The cutting edge 30 extends around all four sides of the tooth 26 so that a cutting edge can be renewed by loosening the attachment screw and rotating the tooth 26 through 90°. Once the tooth has been fully rotated and the cutting edge 30 on all sides is worn by use, the tooth 26 can be removed and replaced.

As can be seen, the recesses 28 are also tapered, which taper, along with the taper on the teeth 26, provides for a more secure fastening as the attachment screw is tightened.

A hopper 36 is provided beneath the rollers 14, 16 for receiving waste material passing between the rollers 14, 16. The waste material falls onto a chain or belt conveyer 38 (shown in end view in FIG. 1) for discharge at one end of the waste debarker 10, preferably the end opposite to the end wall 21.

The plate 20 is provided with a plurality of smaller plates or fingers 40 which are located at an angle with respect to the plate 20 for shearing the material being processed away from the teeth 26 and to counteract material from jamming or passing between the roller 16 and the lower end of the plate 20.

Closure plates or fingers 42 are also provided on the lower end of the plate 22 leaving only elongate recesses 44 for the rings 24 to pass through to counteract the passing of material between the roller 14 and the plate 22.

Figure 11:
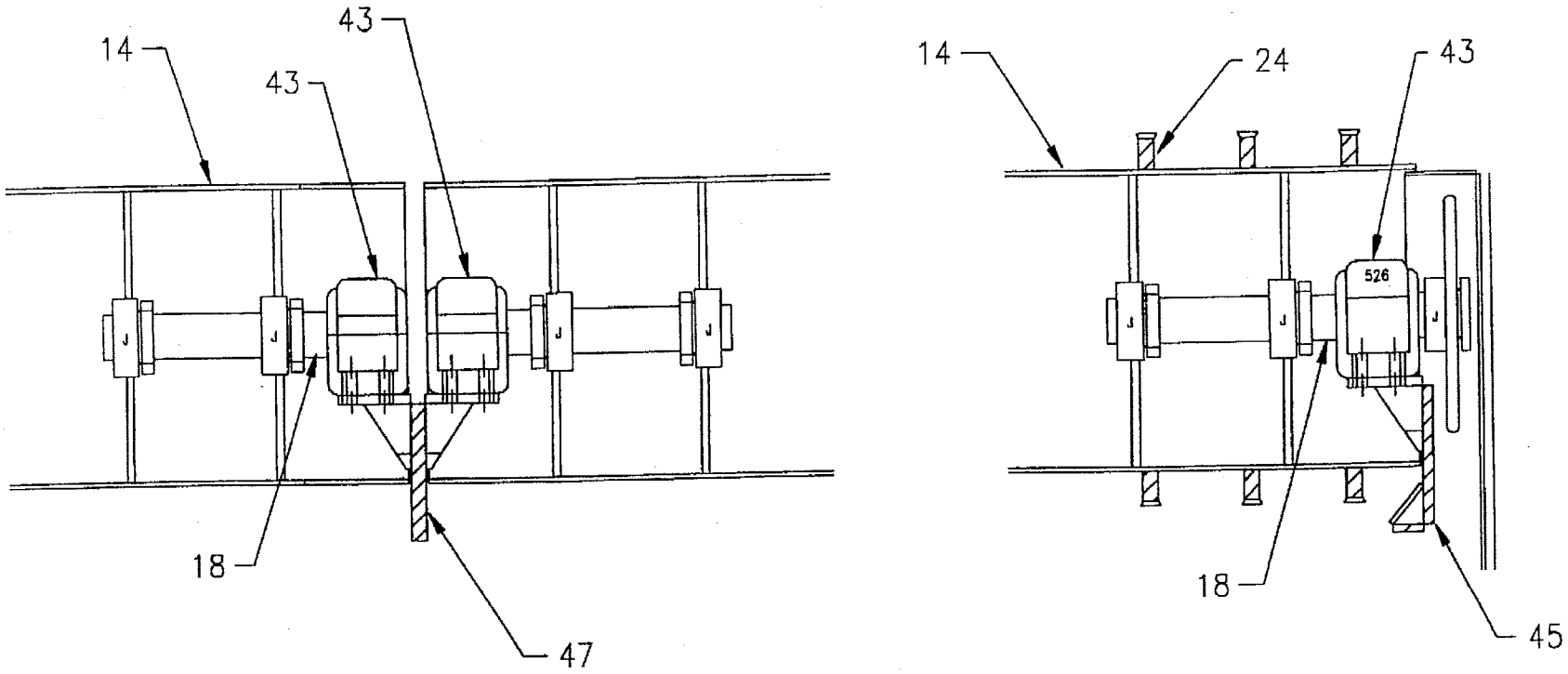
FIG. 11 is a sectional side view showing detail of bearing mountings of the cutting drums.

In the present example the drums 14, 16 have a diameter of 30" and are each 25' long. The rings 24 on the drums 14 are 1.5" thick with an internal diameter of 30" and external diameter of 36". The rings 24 are centered at 10" apart. If desired, two sets of the drums 14, 16 may be bolted together in end to end relationship to provide a debarker of double the length, e.g. 50' long. Such an arrangement is shown in FIG. 11 in respect of two of the drums 14 which are connected together in end to end relationship. As shown, bearings 43 are provided at the opposite ends of each drum 14. The bearings 43 at the ends of the drums 14 facing away from each other are supported by brackets 45 (only one such end is shown in FIG. 11). The bearings 43 at the abutting ends of the drums 14 are mounted on a bracket 47. The shafts 18, on which the drums 14 are mounted are received in the bearings 43 for rotation, as shown. It can be seen that the bearings 43 are located inside the drums 14 which allows for the abutting ends of the drums 14 to be located close together, e.g. 2" apart. A similar arrangement is used for the drums 16.

Figure 6:
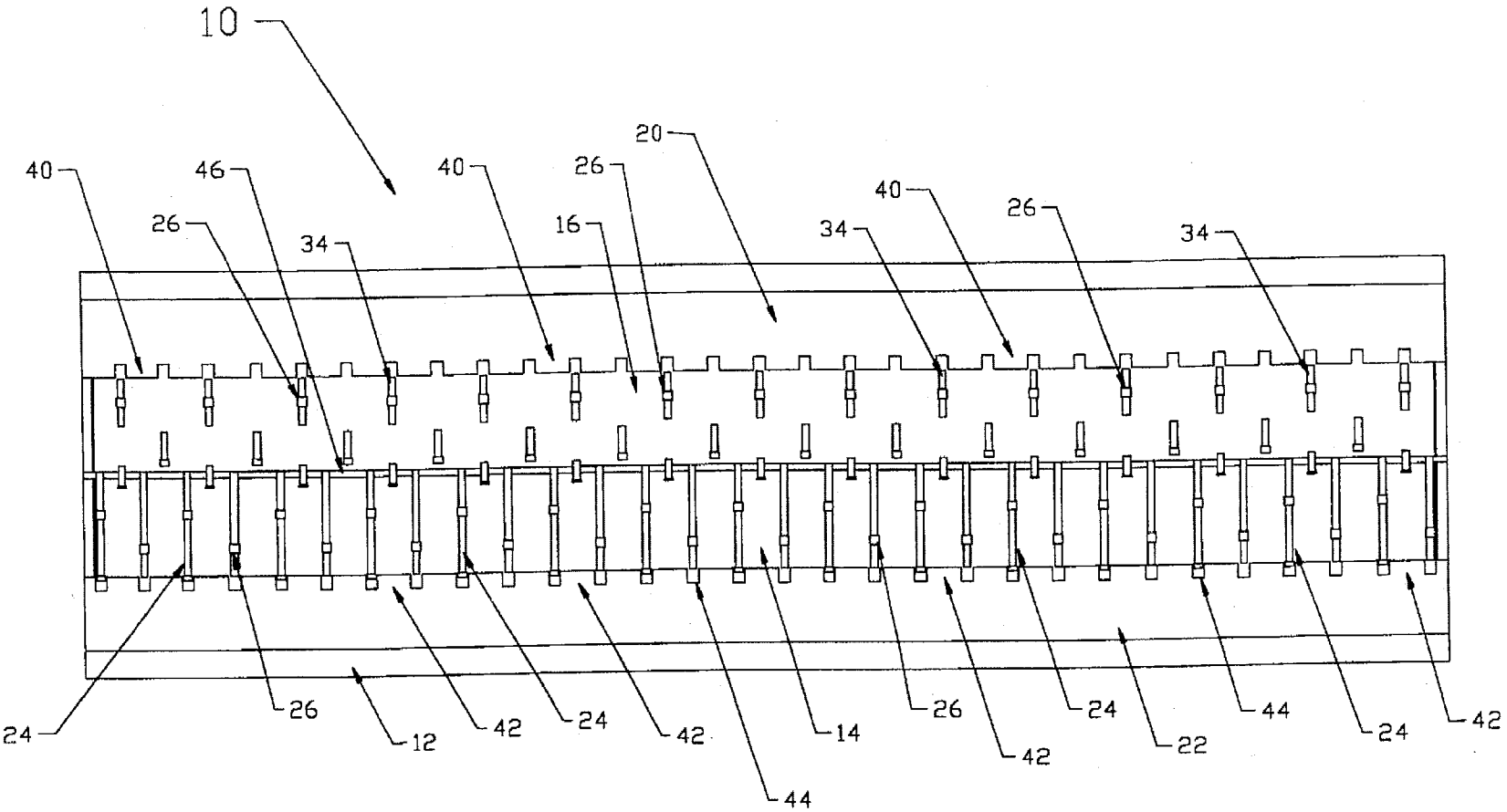
FIG. 6 is a plan view of the waste debarker of FIG. 1.

As can be seen from FIG. 6, the lugs 34 on the drum 16 are offset from the flanges 24 on the drum 14. The drums 14 and 16 are spaced from each other to leave a space 46 in between them, but are close enough so that the tips of the lugs 34 project into the spaces between the flanges 24 as the drums 14, 16 are rotated.

In use, the drums 14, 16 are rotated in the same direction, which is counterclockwise as seen from the end view shown in FIG. 1. As seen from above, the lower roller 14 is rotated in a direction which is towards the upper roller 16.

In order to process the waste material, the debarker 10 is sloped at an angle in the longitudinal direction. Waste material to be processed, such as sawmill yard waste, is introduced at the higher end of the debarker 10. The rotating rollers 14, 16 with the teeth 26 thereon, act upon the material in a way similar to a scrubbing action to remove bark, dirt and small pieces of broken wood and debris which pass through the space 46 between the rollers 14, 16 while the cleaned wood material travel down the slope along the top of the rollers 14, 16 to be discharged at the lower end of the debarker for further processing into wood chips.

The fact that the upper roller 16 is rotated at a greater speed than the lower roller 14 facilitates smooth operation of the debarker 10 and counteracts jamming of material in between the rollers 14,16.

The discharge of the treated wood material is controlled by the gate 25 which can be operated manually or connected to a timer for opening at predetermined intervals. The treatment time can be increased by keeping the gate 25 closed to prevent partially treated material which reaches the discharge end to be discharged prematurely.

The debris that passes through the drums 14, 16 drops onto the chain or belt conveyor 38 and is discharged.

The slope of the debarker 10 can be adjusted in order to control the retention time in the debarker 10. This can, for example, be effected by levelling legs.

Figure 13:
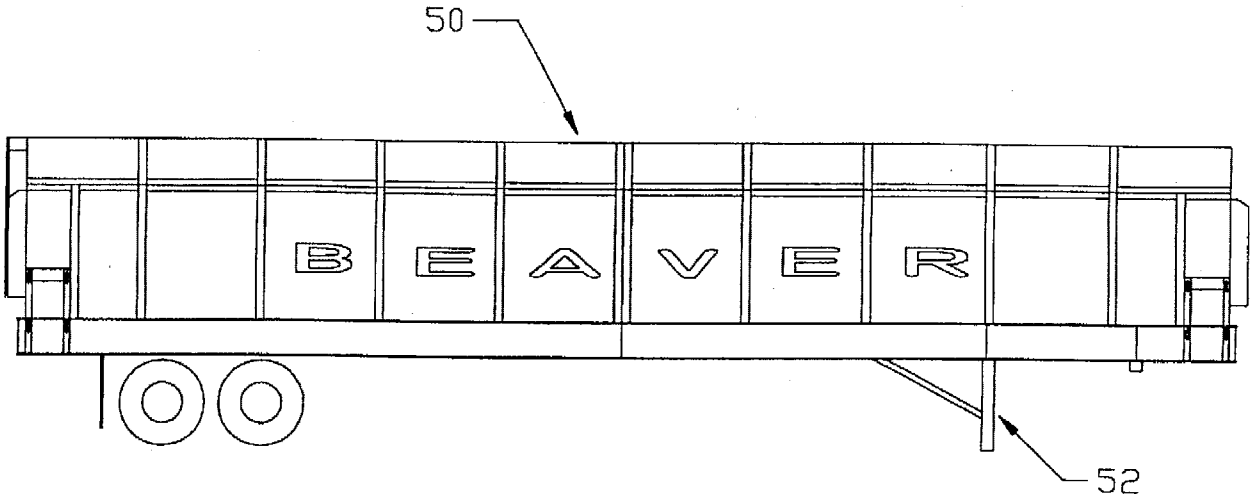
FIGS. 12 and 13, respectively, show end and side views of the waste debarker of the invention in portable form.
Figure 12:
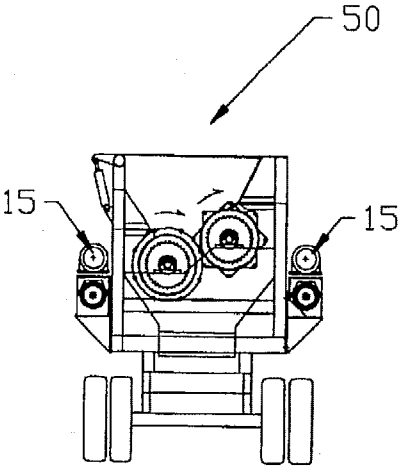

The debarker 10 may be installed as a stationary unit as shown in FIG. 1 or be provided with wheels for towing by a truck type tractor, such as the unit indicated by reference numeral 50 in FIGS. 12 and 13. The unit 50 is provided with a pair of levelling legs 52.

While only preferred embodiments of the invention have been described herein in detail, the invention is not limited thereby and modifications can be made within the scope of the attached claims.

What is claimed is:

1. A waste debarker, comprising;

a housing in which is mounted, a rotatable first cutting drum, which has spaced along the length thereof, a plurality of circumferentially extending flanges for supporting cutting teeth thereon; and a rotatable second cutting drum arranged in a longitudinally spaced relationship with respect to the first drum, the second drum having a plurality of discrete lugs arranged on its surface for supporting cutting teeth thereon, the lugs being offset with respect to the flanges on the first drum and extending in between the flanges as the drums are rotated;

and wherein the second drum is located at a higher elevation than the first drum.

2. The waste debarker according to claim 1, wherein the lugs are arranged in diametrically opposed pairs on the surface of the second drum.

3. The waste debarker according to claim 1, wherein the lugs in adjacent pairs are offset at 45° with respect to each other.

4. The waste debarker according to claim 1, wherein each of the flanges on the first drum is provided with a plurality of recesses spaced around its circumference, each recess being provided with a screw-threaded hole for securing a replaceable cutting tooth therein by means of a bolt extending through the tooth.

5. The debarker according to claim 4, wherein each of the lugs is substantially triangular shaped in side view, each lug being mounted on the surface of the second drum along its base and having a screw-threaded hole at its apex for securing a replaceable cutting tooth therein by means of a bolt extending through the tooth.

6. The debarker according to claim 5, further comprising a conveyor located beneath the drums for receiving waste material falling thereon from between the first and second drums.

7. The debarker according to claim 1, further comprising a first inclined plate located above the first drum and extending along the length of the first drum and a second inclined plate located above the second drum and along the length of the second drum, the first and second inclined plates forming a hopper above the drums for receiving waste material to be treated therein.

8. The waste debarker according to claim 7, wherein the second inclined plate is provided with a plurality of fingers extending along its lower end, said fingers intermeshing with the lugs as the second drum is rotated to counteract the entry of waste material being processed from passing between the second drum and the lower end of the second plate.

9. The waste debarker according to claim 7, wherein the first inclined plate is provided with a plurality of fingers extending along its lower end, said fingers intermeshing with the flanges as the first drum is rotated to counteract the entry of waste material being processed from passing between the first drum and the lower end of the first plate.

10. The waste debarker according to claim 1, further provided with a discharge opening in said housing and a gate for opening and closing said discharge opening.

11. A method of debarking waste material, comprising the steps of:

introducing the waste material between a pair of longitudinally spaced cutting drums which are being rotated in the same direction;

the drums comprising a first drum, which has spaced along the length thereof, a plurality of circumferentially extending flanges with cutting teeth thereon; and a second drum having a plurality of discrete cutting teeth supporting lugs arranged on its surface offset with respect to the flanges on the first drum and extending in between the flanges as the drums are rotated, the second drum being located at a higher elevation than the first drum; and the first drum when viewed from above being rotated in a direction towards the second drum and the second drum being rotated in a direction away from the first drum when viewed from above.

12. The method according to claim 11, wherein the lugs are arranged in diametrically opposed pairs on the surface of the second drum.

13. The method according to claim 11, wherein the lugs in adjacent pairs are offset at 45° with respect to each other.

14. The method according to claim 11, wherein the lugs are substantially triangular shaped in side view, each by being mounted on the surface of the second drum along its base and having a cutting tooth at its apex.

15. The method according to claim 11, wherein the lower drum is rotated at a slower speed than the upper drum.

* * * * *